US006568302B2

(12) United States Patent
Tucker et al.

(10) Patent No.: US 6,568,302 B2
(45) Date of Patent: May 27, 2003

(54) TELESCOPING SUPPORT DEVICE FOR FASTENER DRIVING TOOL

(75) Inventors: Kevin M. Tucker, Chicago, IL (US); Larry Reinebach, Gglen Ellyn, IL (US); Louis Thomas, Maywood, IL (US); Robert G. Kobetsky, Chicago, IL (US); Norbert K. Kolodziej, Park Ridge, IL (US)

(73) Assignee: Illinois Tool Works Inc, Glenview, IL (US)

( * ) Notice: Subject to any disclaimer, the term of this patent is extended or adjusted under 35 U.S.C. 154(b) by 148 days.

(21) Appl. No.: 09/928,118

(22) Filed: Aug. 10, 2001

(65) Prior Publication Data

US 2003/0029282 A1 Feb. 13, 2003

(51) Int. Cl.[7] ..... B25B 23/06
(52) U.S. Cl. ..... 81/434; 227/136
(58) Field of Search ..... 81/434, 433, 451, 81/452, 57.37; 227/136, 120, 123

(56) References Cited

U.S. PATENT DOCUMENTS 4,146,071 A * 3/1979 Mueller et al. ..... 81/434
5,186,085 A * 2/1993 Monacelli ..... 81/434
5,220,123 A 6/1993 Oehry ..... 89/1.14
5,337,635 A * 8/1994 Habermehl ..... 81/434
5,469,767 A * 11/1995 Habermehl ..... 81/434
5,699,704 A * 12/1997 Habermehl ..... 81/434
5,819,609 A * 10/1998 Habermehl ..... 81/434
5,943,926 A * 8/1999 Habermehl ..... 81/434
6,055,891 A * 5/2000 Habermehl ..... 81/434

* cited by examiner

*Primary Examiner*—Joseph J. Hail, III
*Assistant Examiner*—David B. Thomas
(74) *Attorney, Agent, or Firm*—Lisa M. Soltis; Mark W. Croll; Donald J. Breh

(57) ABSTRACT

A support device for use within a fastener driving tool is fixedly attached to the tool's workpiece contact element so as to be movable therewith between extended and retracted positions. When the workpiece contact element, and the support device mounted thereon, are moved to the retracted position, a pocket or recessed portion of the support device will envelop a tip portion of a second uppermost fastener disposed within the tool magazine, while the first uppermost fastener is disposed within the tool drive bore, such that the second uppermost fastener, as well as the remaining fasteners within the magazine, is properly supported and stabilized such that shock and vibrational forces, attendant the driving of the first uppermost fastener, are effectively prevented from being transmitted to the second uppermost and remaining fasteners. In addition, the pocket or recessed portion serves to partially close the magazine opening through which the fasteners are serially advanced such that the first uppermost fastener will be maintained coaxially aligned within the tool drive bore, and an upstream leading edge of the pocket or recessed portion also defines a shearing edge for properly shearing those portions of the collation strip which interconnect adjacent pairs of the fasteners within the collated strip of fasteners.

18 Claims, 2 Drawing Sheets

TELESCOPING SUPPORT DEVICE FOR FASTENER DRIVING TOOL

FIELD OF THE INVENTION

The present invention relates generally to fastener driving tools, and more particularly to a new and improved telescoping support device operatively connected to the workpiece engagement probe or work contact element of the fastener driving tool so as to support and stabilize, for example, the second uppermost fastener of a collated array or strip of fasteners, and therefore by extension, the remaining fasteners of the collated array or strip of fasteners disposed within the fastener tool magazine, while the first fastener of the collated array or strip of fasteners is being readied to be sheared and separated from the collated array or strip of fasteners and driven through the tool discharge bore or muzzle and into a substrate by means of a suitable driver blade mechanism or the like, and in addition, the support device also serves to assist in the shearing and separation of the first uppermost fastener from the remaining fasteners disposed within the collated strip or array of fasteners, as well as to prevent misalignment of the first uppermost fastener as the same is being driven within and through the drive bore of the tool by the driver blade mechanism.

BACKGROUND OF THE INVENTION

In connection with the attachment, for example, of sheathing materials to substrates comprising, for example, light to medium gauge steel, the fastener installation tools conventionally being used are most often electrically-powered screw guns. These tools, however, are often cumbersome and are sometimes deficient in the amount of power they can generate in connection with the driving of the fasteners into the light to medium gauge steel substrates. As an alternative to the aforenoted electrically-powered screw guns, pneumatically-powered fastener driving tools have been utilized, however, such pneumatically-powered fastener-driving tools have not been deemed commercially acceptable, and therefore has not enjoyed widespread commercial success, in view of the need for an air compressor and operatively associated air hose in order to power the tool. In addition, such pneumatically-powered tools also exhibit some of the operational drawbacks characteristic of the electrically-powered screw guns in that they are cumbersome to use and do not consistently generate the requisite amount of power required to drive the fasteners in order to, for example, secure exterior sheathing materials to steel frames or substrates. Portable, self-contained combustion-powered fastener driving tools are therefore usually preferred in connection with the overall utility, operational convenience and efficiency, and the requisite amount of power that can be generated by means of such fastener driving tools. In any case, regardless of the particular type of fastener driving tool which is employed, all conventional fastener driving tools comprise internal structural assemblies which exhibit or present potential problems or difficulties in connection with the continuous operation of the fastener driving tools in an operationally consistent and efficient manner whereby frequent operational shut-downs of the tool, because of necessary repair or maintenance procedures, are effectively obviated.

For example, in connection with conventional fastener driving tools wherein a plurality of fasteners are disposed within the tool magazine by means of a collated array or strip of fasteners, it is desirable and important to maintain proper coaxial alignment of the first uppermost fastener within the drive bore and muzzle sections of the fastener driving tool as the first uppermost fastener is being driven through the drive bore and muzzle sections of the fastener driving tool such that first uppermost driven fastener does not become jammed within the tool, or in addition, such that the first uppermost driven fastener is not ultimately improperly inserted and installed, that is, in a skewed or tilted manner, within the particular substrate into which the fastener is desirably being installed. In addition, it is likewise desirable and important that the second uppermost fastener within the collated array or strip of fasteners, and thereby, by extension, all of the remaining or residual fasteners within the collated array or strip of fasteners, be properly supported and stabilized in order to prevent or reduce severe shock or vibrational forces from being impressed upon all of such remaining or residual fasteners of the collated array or strip of fasteners disposed within the tool magazine so as to effectively prevent the structural integrity of the collation strip or band securing the plurality of fasteners together within the collated array or strip of fasteners from being adversely affected whereby, for example, any shredding or even partial disintegration of the same could result in improper support and jamming of the fasteners within the tool magazine. Still yet further, it is desirable and important to ensure that the first uppermost fastener is properly sheared and separated from the remaining or residual fasteners, comprising the collated array or strip of fasteners disposed within the tool magazine, at a substantially precise proper location such that the first uppermost fastener does not become misaligned within the drive bore and muzzle sections of the fastener driving tool, or that excess collation strip debris is not generated, either one of which scenarios can cause jamming of the tool and operational inefficiency.

A need therefore exists in the art for a new and improved telescoping support device operatively connected to the workpiece engagement probe or work contact element of the fastener driving tool which can support and stabilize, for example, the second uppermost fastener of a collated array or strip of fasteners, and therefore by extension, the remaining fasteners of the collated array or strip of fasteners disposed within the fastener tool magazine, while the first fastener of the collated array or strip of fasteners is being readied to be sheared and separated from the collated array or strip of fasteners, and driven in a properly aligned manner through the tool discharge bore or muzzle and into a substrate by means of a suitable driver blade mechanism or the like, which can facilitate the proper shearing and separation of the first uppermost fastener from the remaining or residual fasteners of the collated array or strip of fasteners disposed within the tool magazine, and which can facilitate the proper coaxial alignment of the first uppermost fastener while the same is being driven through the drive bore and muzzle sections of the fastener driving tool.

OBJECTS OF THE INVENTION

Accordingly, it is an object of the present invention to provide a new and improved telescoping support device operatively connected to the workpiece engagement probe or work contact element of the fastener driving tool so as to support, for example, the second uppermost fastener of a collated array or strip of fasteners, and therefore by extension, the remaining fasteners of the collated array or strip of fasteners disposed within the fastener tool magazine, during a fastener driving operation.

Another object of the present invention is to provide a new and improved telescoping support device operatively connected to the workpiece engagement probe or work contact element of the fastener driving tool so as to support, for example, the second uppermost fastener of a collated array or strip of fasteners, and therefore by extension, the remaining fasteners of the collated array or strip of fasteners disposed within the fastener tool magazine, during a fastener driving operation so as to overcome the various operative disadvantages and drawbacks characteristic of PRIOR ART fastener driving tools.

An additional object of the present invention is to provide a new and improved telescoping support device operatively connected to the workpiece engagement probe or work contact element of the fastener driving tool so as to support, for example, the second uppermost fastener of a collated array or strip of fasteners, and therefore by extension, the remaining fasteners of the collated array or strip of fasteners disposed within the fastener tool magazine, during a fastener driving operation so as to provide the second uppermost fastener with a requisite amount of support and stability.

A further object of the present invention is to provide a new and improved telescoping support device operatively connected to the workpiece engagement probe or work contact element of the fastener driving tool so as to support, for example, the second uppermost fastener of a collated array or strip of fasteners, and therefore by extension, the remaining fasteners of the collated array or strip of fasteners disposed within the fastener tool magazine, during a fastener driving operation so as to facilitate the proper shearing and separation of the first uppermost fastener of the collated array or strip of fasteners from the remaining fasteners disposed within the tool magazine.

A last object of the present invention is to provide a new and improved telescoping support device operatively connected to the workpiece engagement probe or work contact element of the fastener driving tool so as to support, for example, the second uppermost fastener of a collated array or strip of fasteners, and therefore by extension, the remaining fasteners of the collated array or strip of fasteners disposed within the fastener tool magazine, during a fastener driving operation so as to effectively prevent misalignment of the first uppermost fastener within the collated array or strip of fasteners during the driving of the first uppermost fastener through the discharge bore or muzzle of the fastener driving tool.

SUMMARY OF THE INVENTION

The foregoing and other objectives are achieved in accordance with the teachings and principles of the present invention through the provision of a new and improved telescoping support device operatively connected to the workpiece engagement probe or work contact element of the fastener driving tool so as to support, for example, the second uppermost fastener of a collated array or strip of fasteners, and therefore by extension, the remaining fasteners of the collated array or strip of fasteners disposed within the fastener tool magazine, during a fastener driving operation so as to facilitate the proper shearing and separation of the first uppermost fastener of the collated array or strip of fasteners from the remaining fasteners disposed within the tool magazine. More particularly, the support device comprises a tubular pocket or a pair of prongs within which the forward or nose portion of the second uppermost fastener of the collated array or strip of fasteners is disposed when the workpiece engagement probe or work contact element, and the support device fixedly mounted thereon, is effectively moved rearwardly as the fastener driving tool is moved forwardly toward the substrate into which the fasteners are to be driven. The forward or nose portion of the second uppermost fastener within the collated array or strip of fasteners is therefore adequately supported and stabilized such that the first uppermost fastener within the collated array or strip of fasteners can in fact be sheared, separated, and driven in a properly aligned manner through the discharge bore or muzzle of the fastener driving tool while shock forces normally imparted to the remaining fasteners within the collated array or strip of fasteners are optimally minimized. In addition, the support device also structurally cooperates with the driving bore and muzzle structure so as to facilitate and maintain coaxial alignment of the driven fastener within the drive bore and muzzle structures of the fastener driving tool, and still further, the leading or upstream edge or end portion of the support device effectively serves as a shearing edge so as to ensure proper shearing of the collation strip at a substantially precise location halfway between adjacent pairs of interconnected fasteners disposed upon the collated array or strip of fasteners.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
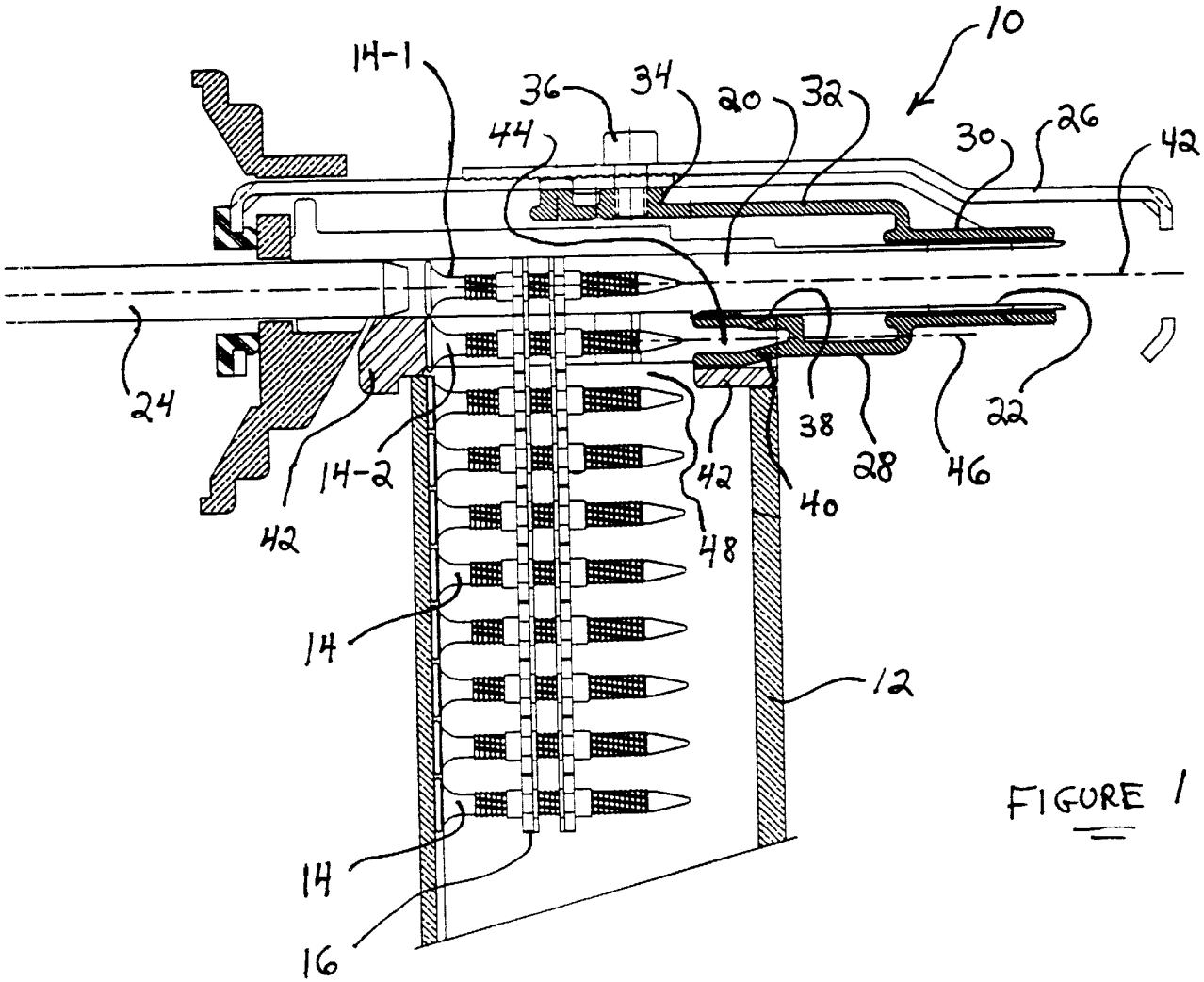
FIG. 1 is a partial, vertical cross-sectional view of a fastener driving tool showing the new and improved support device, constructed in accordance with the teachings and principles of the present invention, operatively associated with the workpiece engagement probe or workpiece contact element prior to the rearward movement of the workpiece engagement probe or workpiece contact element, and the support device fixedly mounted thereon, in response to forward movement of the tool toward the substrate into which the fasteners are to be driven.
Figure 2:
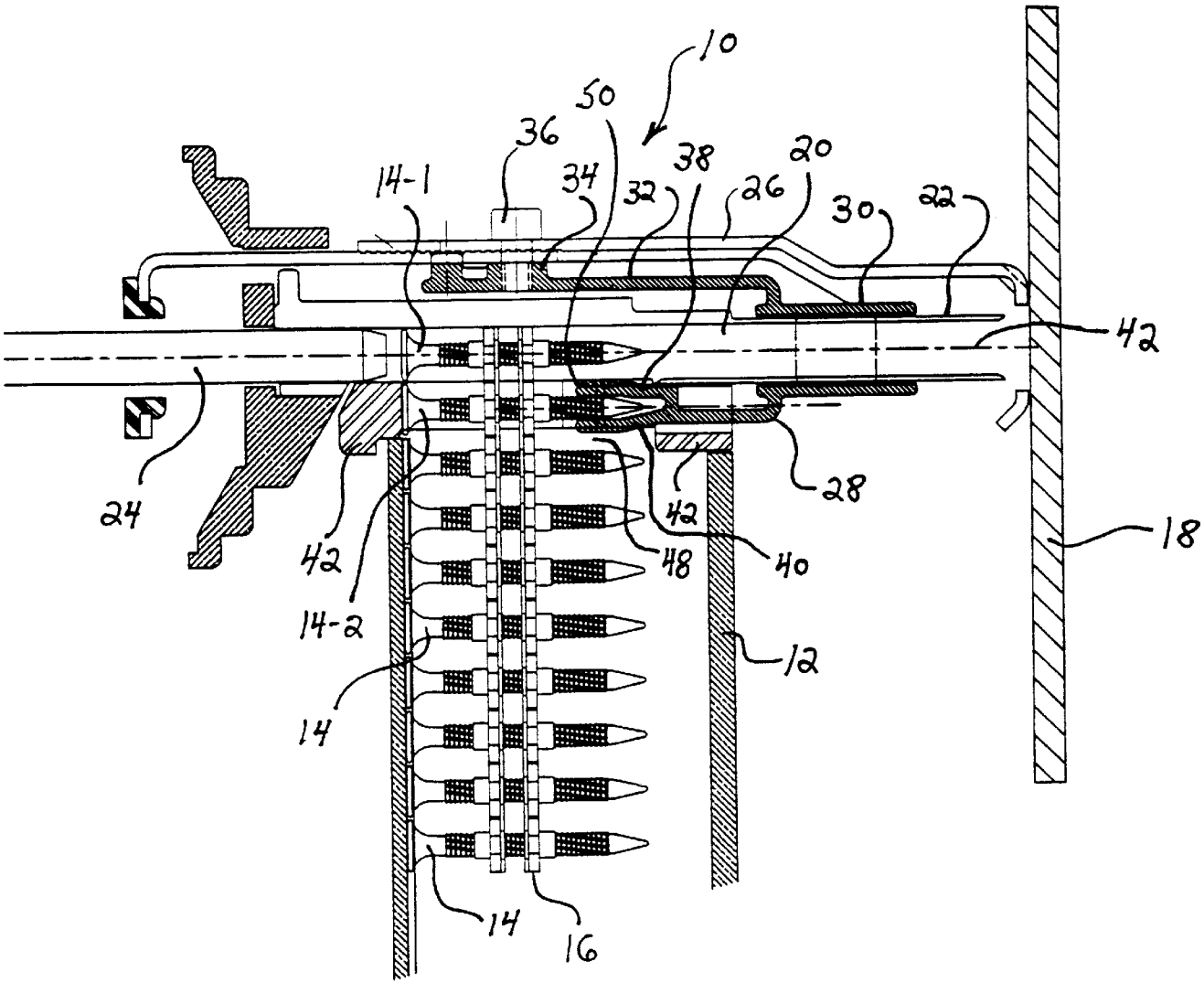
FIG. 2 is a partial, vertical cross-sectional view similar to that of FIG. 1 illustrating, however, the fastener driving tool, having the new and improved support device, constructed in accordance with the teachings and principles of the present invention, operatively associated with the workpiece engagement probe or workpiece contact element, when the workpiece engagement probe or workpiece contact element, and the support device fixedly mounted thereon, has in fact been moved rearwardly in response to the forward movement of the tool toward the substrate into which the fasteners are to be driven, such that the support device is now operatively engaged with the forward or nose portion of the second uppermost fastener of the collated array or strip of fasteners disposed within the tool magazine so as to support and stabilize such second uppermost fastener while simultaneously facilitating the shearing and separation of the first uppermost fastener from the remaining fasteners disposed within the collated array or strip of fasteners as well as preventing the misalignment of such first uppermost fastener as such first uppermost fastener is driven through the driving tool discharge bore or muzzle.

Referring now to the drawings, and more particularly to FIGS. 1 and 2 thereof, a new and improved fastener driving tool, having a new and improved support device integrally incorporated therein for supporting the second uppermost fastener of a collated array or strip of fasteners, and therefore by extension, the remaining fasteners of a collated array or strip of fasteners disposed within a fastener tool magazine, during a fastener driving operation, is disclosed and is generally indicated by the reference character 10. The fastener driving tool 10 comprises, in part, a magazine 12 within which a collated array or strip of fasteners 14 is disposed such that uppermost ones of the fasteners 14 can be serially readied for severance, separation, and discharge from the tool 10 in accordance with a fastener firing and driving operation. As is conventionally known, the collated array or strip of fasteners 14 comprises a plurality of fasteners 14 which are secured together by means of a frangible collation strip 16 or other bond means, which is affixed to, for example, central portions of the fastener shanks, such that the plurality of fasteners 14 can in effect be loaded into the tool magazine 12 en masse but, in addition, the plurality of fasteners 14 can also be subsequently individually and serially separated from each other as the fastener driving tool is sequentially fired so as to drive the individual fasteners 14 into a particular substrate. For the purposes of this disclosure, the particular substrate may comprise, for example, steel framework structure, not shown, onto which sheathing materials 18, as shown in FIG. 2, are to be fixedly secured.

As is also conventionally known, the collated array or strip 16 of fasteners 14 is operatively associated with a spring-biasing mechanism, not shown, by means of which, as viewed in FIGS. 1 and 2, the collated strip 16 of fasteners 14 will be constantly biased upwardly so as to serially present and dispose the first uppermost fastener 14-1 within a fastener tool drive bore 20. The forward, right, or downstream exit end of the drive bore 20 has a muzzle member 22 fixedly mounted therein so as to guide the first uppermost fastener 14-1 toward the substrate, not shown, as the first uppermost fastener 14-1 is being driven and discharged from the tool 10, and a suitable driving member, such as, for example, a driver blade or rod 24, is operatively disposed within the rear, left, or upstream end of the drive bore 20 so as to engage the head portion of the first uppermost fastener 14-1 when the tool 10 is fired. The driver blade or rod 24 is adapted, as is also well known, to be acted upon by means of a piston member, not shown, which is actuated in accordance with the firing sequence of the tool 10, and it is noted that the particular fastener driving tool 10 may either be combustion powered, pneumatically powered, powder actuated, or the like. The fastener driving tool 10 is further seen to conventionally comprise a workpiece engagement probe or workpiece contact element 26 which, as is also well known, comprises, in effect, a safety mechanism by means of which the tool 10 cannot be fired until the probe or element 26 is initially disposed in contact with the substrate, into which the fasteners 14 are to be installed, and subsequently, the tool 10 is moved toward the substrate so as to effectively cause the workpiece engagement probe or workpiece contact element 26 to be moved relatively rearwardly or toward the left, as viewed in the drawings, from an extended position as shown in FIG. 1 to a retracted position as shown in FIG. 2. Only when these compound or cooperative movements or operations are performed can the firing mechanism of the fastener driving tool 10 be initiated or actuated whereby the fastener driving tool 10 can then in fact be fired.

In connection with fastener driving tools similar to the disclosed fastener driving tool 10, it can be further appreciated that when the first uppermost fastener 14-1 is to be severed, separated, and driven by means of the driver rod or blade 24, it is important and desirable to maintain the coaxial alignment of the first uppermost fastener 14-1 within and with respect to the drive bore 20 and the muzzle member 22 so as not to cause jamming of the fastener 14-1 within the tool 10, or improper, that is, tilted or skewed, insertion or installation within the substrate. In addition, it is also important and desirable to adequately support and stabilize the second uppermost fastener 14-2 within the tool magazine 12 such that the first uppermost fastener 14-1 can in fact be easily, cleanly, and rapidly severed and separated from the remaining fasteners 14 disposed within the collated array or strip 16 of fasteners 14 without the imposition of severe shock or vibrational forces onto the remaining or residual fasteners 14 disposed within the collated array or strip 16 of fasteners 14 so as not to adversely affect the structural integrity of the collation strip 16 binding the plurality of fasteners 14 together. In connection with such severance and separation of the first uppermost fastener 14-1 from the remaining or residual fasteners 14 disposed within the collated array or strip 16 of fasteners 14, it is likewise important and desirable to ensure the fact that the first uppermost fastener 14-1, disposed within the drive bore 20 of the tool 10, is always severed and separated from the remaining or residual fasteners 14 disposed within the collated array or strip 16 of fasteners 14 at substantially precisely the same location or region of the collated strip 16, that is, along a shear plane which is located halfway between adjacent ones of the contiguous fasteners 14 secured together within the collated array or strip 16 of fasteners 14, so as to, again, not cause any misalignment or jamming of any one of the fasteners 14 within the tool 10, or so as not to cause the generation of any excess collation strip debris within the drive bore 20 which could likewise causing jamming of the tool 10.

In accordance, therefore, with the unique and novel structure which has been developed in accordance with the principles and teachings of the present invention, and which therefore characterizes the import or significance of the present invention, and with reference again being made to FIGS. 1 and 2, it is seen that the fastener driving tool 10 further comprises a fastener support device 28 which comprises a first downstream tubular body section 30 which has a relatively small diametrical extent so as to be slidably disposed upon the muzzle member 22, and a second upstream tubular body section 32 which has a relatively large diametrical extent. A first side wall portion of upstream tubular body section 32 is axially extended so as to define an attachment portion 34 by means of which the fastener support device 28 is fixedly attached to an upstream portion of the workpiece engagement probe or workpiece contact element 26 through means of a suitable fastener 36, while a second diametrically opposite side wall portion of the fastener support device 28 is provided with a pair of radially inner and radially outer prongs 38,40 as considered with respect to the longitudinal axis 42 as defined within the drive bore 20 and muzzle member 22 and along which the first uppermost fastener 14-1 will be driven. It is to be noted that in lieu of the provision of the pair of radially inner and radially outer prongs 38,40, the support device 28 may be provided with a single tubular finger which can effectively serve the same purpose as the two radially inner and radially outer prongs 38,40.

As can be appreciated from FIG. 1, when the tool or apparatus 10 is disposed in its normal, non-working mode whereby, for example, the workpiece engagement probe or workpiece contact element 26 is not engaged or disposed in contact with a substrate into which fasteners 14 are to be driven, radially inner prong 38 is seated upon an upstream end portion of the muzzle member 22, while radially outer prong 40 is seated upon a downstream end portion of a support block 42. It is also noted that when the collated array or strip 16 of fasteners 14 is operationally mounted within the magazine 12, the head portion of the second uppermost fastener 14-2 is seated upon an upstream end portion of the support block 42, and that a pocket or recess 44, which is effectively defined between the radially inner and radially outer prongs 38,40, is coaxially aligned with the longitudinal axis 46 of the second uppermost fastener 14-2. It is further appreciated that the downstream end portion of the support block 42 and the upstream end portion of the support block 42 are separated from each other by means of a space or a slot 48 defined therebetween so as to permit the collated strip 16 of fasteners 14 to pass therethrough.

As has been noted hereinbefore, in order to optimize the operation of the fastener driving tool 10 without encountering jamming of the same, or misaligned driving of the fasteners 14 therefrom and into a particular substrate, it is imperative that the first uppermost fastener 14-1 be maintained coaxially aligned within the drive bore 20 and the muzzle member 22 as the first uppermost fastener 14-1 is being sheared, separated, and driven through the drive bore 20 and muzzle member 22 for discharge from the fastener driving tool 10 and installation into a particular substrate. In addition, it is likewise imperative that the second uppermost fastener 14-2 be properly and adequately supported while the first uppermost fastener 14-1 is being sheared, separated, and driven through the drive bore 20 and muzzle member 22 of the fastener driving tool 10 so as to effectively prevent shock and vibrational forces from being impressed upon the remaining or residual fasteners 14 disposed within the collated array or strip 16 of fasteners 14 so as not to cause any fracture, disintegration, or otherwise adverse effects upon the structural integrity of the collated array or strip 16 of fasteners 14. Lastly, it is imperative to ensure that the individual fasteners 14 are sheared and separated from each other at substantially the same location between each adjacent pair of fasteners 14 so as not to cause misalignment of a particular fastener 14 or to generate excess collation strip debris which could tend to jam the tool 10. The provision of the support device 28, constructed in accordance with the principles and teachings of the present invention, meets and provides the aforenoted operational requirements.

More particularly, as can be appreciated by means of a comparison between FIGS. 1 and 2, when the workpiece engagement probe or workpiece contact element 26 is moved, from the position shown in FIG. 1, relatively toward the left, as viewed in the drawings, as the fastener driving tool 10 is moved toward the right so as to be moved toward the substrate into which the fasteners 14 are to be driven, it is seen that the fastener support device 28 is likewise moved relatively toward the left, along with the workpiece engagement probe or contact element 26, to the position as shown in FIG. 2. Accordingly, the prongs 38,40 of the fastener support device 28 will envelop the tip portion of the second uppermost fastener 14-2 and will simultaneously partially close the opening, space, or slot 48 defined within the support block 42. Therefore, since the opening, space, or slot 48 is now partially closed, the upstream end portion of the fastener support device 28, as defined, for example, by means of the radially inner prong 38, serves in effect as an upstream extension of the muzzle member 22 so as to support the first uppermost fastener 14-1 as the same is beginning to be driven through the drive bore 20 and the muzzle member 22. In this manner, the first uppermost fastener 14-1 will be properly supported, in a coaxial manner with respect to longitudinal axis 42, during the driving operation of the first uppermost fastener 14-1 through the drive bore 20 and the muzzle member 22 by means of the driver blade 24.

It is to be further appreciated that as a result of the disposition of the tip portion of the second uppermost fastener 14-2 within the pocket or recess 44 defined between the radially inner and radially outer prongs 38,40, the support device 28 provides the necessarily required support and stability to the second uppermost fastener 14-2, and by extension, to the entire collated array or strip 16 of fasteners 14, during the driving operation of the first uppermost fastener 14-1 such that substantial shock and vibrational forces, normally impressed upon the collated array or strip 16 of fasteners 14 as a result of the fastener severing and driving operation, are substantially reduced or minimized whereby damage to, or fractures which would normally be induced within, the collated array or strip 16 of fasteners 14, will be effectively prevented. Still further, it is lastly to be appreciated that the upstream edge portion 50 effectively defines a shearing edge which is substantially aligned with a shear plane which is located halfway between adjacent pairs of the fasteners 14. Consequently, when the driver blade member 24 is actuated so as to drive the first uppermost fastener 14-1 toward the right, as viewed in the drawings, the thermoplastic material from which the collation strip or band 16 will be somewhat elongated and stretched whereupon encountering the shearing edge 50 of the radially inner prong 38, the driving force imparted to the fastener 14-1, in combination with the shearing forces impressed upon the collation strip or band 16 by means of the shearing edge 50, will cause the collation strip or band 16 to be severed. In addition, it is to be particularly noted that due to the fixed radial disposition of the shearing edge 50 of the radially inner prong 38 with respect to, for example, either one of the axes 42,46, the severance or shearing of the collation strip 16 at the interface defined between the first and second uppermost fasteners 14-1,14-2 will always be the same so as to provide consistently reliable severance and separation of adjacent fasteners 14.

It is lastly to be noted that in view of the disposition of the support device 28 with respect to the collated array or strip 16 of fasteners 14 disposed within the tool magazine 12, and more particularly, in view of the positional relationship defined between the prong members 38, 40 of the support device 28 and the second uppermost fastener 14-2, immediately preceding, during, and immediately subsequent to the firing and discharge of the first uppermost fastener 14-1, that is, in view of the fact that the prongs 38,40 effectively envelop the tip portion of the second uppermost fastener 14-2 such that the tip portion of the second uppermost fastener 14-2 is disposed within the pocket or recess 44 defined between the prongs 38,40, as shown in FIG. 2, advancement of the collated array or strip 16 of fasteners 14 upwardly within the magazine 12 is effectively prevented unless and until the fastener driving tool 10 is retracted away from the substrate so as to correspondingly permit the workpiece engagement probe or contact element 26 to regain its extended position as shown in FIG. 1. Such movement of course correspondingly moves the support device 28 to its position as shown in FIG. 1 whereby the interengagement of the support device 28 with the second uppermost fastener 14-2 is terminated. The collated array or strip 16 of fasteners 16 is now therefore permitted to be advanced upwardly within the tool magazine 12 whereby the previously designated second uppermost fastener 14-2 will now be disposed at the position previously occupied by the first uppermost fastener 14-1 whereupon a new fastener firing cycle can be commenced.

Thus, it may be seen that in accordance with the principles and teachings of the present invention, a new and improved support device has been provided in conjunction with a fastener driving tool wherein the support device is fixedly mounted upon the workpiece engagement probe or workpiece contact element so as to be telescopically movable therewith between extended and retracted positions, and wherein further, when the workpiece engagement probe or contact element, and the support device, are moved to their respective retracted positions, the support device will partially close the slot defined within the operatively associated support block so as to effectively prevent misalignment of the fastener as the same is being driven through the drive bore and muzzle member of the tool, the support device will envelop the tip portion of the second uppermost fastener so as to support and stabilize the same, as well as the collated array or strip of fasteners so as to prevent shock and impact forces attendant a fastener driving operation from being transmitted to the collated array or strip of fasteners, and an upstream edge portion of the support device will serve as a shearing edge so as to consistently shear and sever the first uppermost fastener from the second uppermost fastener at a predetermined position or interface defined halfway between adjacent pairs of fasteners.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A support device, for use in connection with a fastener driving tool having a workpiece contact element mounted thereon for movement between an extended position and a retracted position, and wherein a collated strip of a plurality of fasteners is disposed within a tool magazine such that a first uppermost one of the plurality of fasteners is disposed within a drive bore of the tool in readiness to be driven out of the tool by a driver mechanism, comprising:

a body section having a portion adapted for attachment to the workpiece contact element so as to be movable with the workpiece contact element between the extended and retracted positions; and means defining a pocket for enveloping a tip portion of a second uppermost one of the plurality of fasteners disposed within the tool magazine, when the support device is moved from the extended position to the retracted position along with the workpiece contact element and when the first uppermost one of the plurality of fasteners is disposed within the drive bore of the tool in preparation for being driven out of the tool by the driver mechanism, for supporting and stabilizing the second uppermost one of the plurality of fasteners disposed within the tool magazine, as well as the remaining ones of the plurality of fasteners disposed within the tool magazine, such that shock and vibrational forces attendant the driving of the first uppermost one of the plurality of fasteners disposed within the tool drive bore are effectively prevented from being transmitted to the second uppermost one of the plurality of fasteners disposed within the tool magazine as well as to the remaining ones of the plurality of fasteners disposed within the tool magazine.

2. The support device as set forth in claim 1, wherein:

said means defining said pocket upon said support device comprises a pair of oppositely disposed prongs.

3. The support device as set forth in claim 1, wherein:

said means defining said pocket upon said support device comprises a tubular finger.

4. A support device, for use in connection with a fastener driving tool having a workpiece contact element mounted thereon for movement between an extended position and a retracted position, and wherein a collated strip of a plurality of fasteners is disposed within a tool magazine such that the plurality of fasteners are adapted to be serially fed through a slot connecting the tool magazine to a tool drive bore within which a first uppermost one of the plurality of fasteners is disposed in readiness to be driven out of the tool by a driver mechanism, comprising:

a body section having a portion adapted for attachment to the workpiece contact element so as to be movable with the workpiece contact element between the extended and retracted positions; and means defining a pocket for enveloping a tip portion of a second uppermost one of the plurality of fasteners disposed within the tool magazine, when the support device is moved from the extended position to the retracted position along with the workpiece contact element and when the first uppermost one of the plurality of fasteners is disposed in the tool drive bore in preparation for being driven out of the fastener driving tool by the driver mechanism, for partially closing the slot connecting the tool magazine to the tool drive bore so as to support and maintain coaxial alignment of the first uppermost one of the plurality of fasteners within the tool drive bore while the first uppermost one of the plurality of fasteners is driven through the tool drive bore so as to effectively prevent misalignment of the first uppermost one of the plurality of fasteners with respect to the tool drive bore as the first uppermost one of the plurality of fasteners is driven through the drive bore in order to effectively prevent jamming of the first uppermost one of the plurality of fasteners within the tool drive bore.

5. The support device as set forth in claim 4, wherein:

said means defining said pocket upon said support device comprises a pair of oppositely disposed prongs.

6. The support device as set forth in claim 4, wherein:

said means defining said pocket upon said support device comprises a tubular finger.

7. A support device, for use in connection with a fastener driving tool having a workpiece contact element mounted thereon for movement between an extended position and a retracted position, and wherein a collated strip of a plurality of fasteners is disposed within a tool magazine such that a first uppermost one of the plurality of fasteners is disposed within a drive bore of the tool in readiness to be driven out of the tool by a driver mechanism, comprising:

a body section having a portion adapted for attachment to the workpiece contact element so as to be movable with the workpiece contact element between the extended and retracted positions; and means defining a pocket for enveloping a tip portion of a second uppermost one of the plurality of fasteners disposed within the tool magazine, when the support device is moved from the extended position to the retracted position along with the workpiece contact element and when the first uppermost one of the plurality of fasteners is disposed within the drive bore of the tool in preparation for being driven out of the tool by the driver mechanism, wherein said pocket means comprises an upstream shear edge portion for causing shearing of a collation strip member of the collated strip of fasteners at a substantially consistent position which is located halfway along the interface connecting the first uppermost one of the plurality of fasteners to the second uppermost one of the plurality of fasteners.

8. The support device as set forth in claim 7, wherein:

said means defining said pocket upon said support device comprises a pair of oppositely disposed prongs.

9. The support device as set forth in claim 7, wherein:

said means defining said pocket upon said support device comprises a tubular finger.

10. A fastener driving tool, comprising:

a workpiece contact element mounted upon said tool for movement between an extended position and a retracted position;

a drive bore defined within said tool through which a fastener is to be driven so as to be discharged from said tool;

a driver mechanism movably disposed within said drive bore for driving a fastener through said drive bore;

a tool magazine for holding a plurality of fasteners;

a collated strip of fasteners disposed within said tool magazine such that a first uppermost one of said collated strip of fasteners is disposed within said drive bore of said tool in readiness to be driven out of said tool by said driver mechanism; and a support device attached to said workpiece contact element, so as to be movable with said workpiece contact element between said extended and retracted positions, and comprising a pocket for enveloping a tip portion of a second uppermost one said collated strip of fasteners disposed within said tool magazine, when said support device is moved from said extended position to said retracted position along with said workpiece contact element and when said first uppermost one of said collated strip of fasteners is disposed within said drive bore of said tool in preparation for being driven out of said tool by said driver mechanism, for supporting and stabilizing said second uppermost one of said collated strip of fasteners disposed within said tool magazine, as well as the remaining ones of said collated strip of fasteners disposed within said tool magazine, such that shock and vibrational forces attendant the driving of said first uppermost one of said collated strip of fasteners disposed within said tool drive bore are effectively prevented from being transmitted to said second uppermost one of said collated strip of fasteners disposed within said tool magazine as well, as to the remaining ones of said collated strip of fasteners disposed within said tool magazine.

11. The fastener driving tool as set forth in claim 10, wherein:

said pocket formed upon said support device comprises a pair of oppositely disposed prongs.

12. The fastener driving tool as set forth in claim 10, wherein:

said pocket formed upon said support device comprises a tubular finger.

13. A fastener driving tool, comprising:

a workpiece contact element mounted upon said tool for movement between an extended position and a retracted position;

a drive bore defined within said tool through which a fastener is to be driven so as to be discharged from said tool;

a driver mechanism movably disposed within said drive bore for driving a fastener through said drive bore;

a tool magazine for holding a plurality of fastener;

a slot connecting said tool magazine to said drive bore;

a collated strip of fasteners disposed within said tool magazine such that a first uppermost one of said collated strip of fasteners is disposed within said drive bore of said tool in readiness to be driven out of said tool by said driver mechanism; and a support device attached to said workpiece contact element, so as to be movable with said workpiece contact element between said extended and retracted positions, and comprising a pocket for enveloping a tip portion of said second uppermost one of said collated strip of fasteners disposed within said tool magazine, when said support device is moved from said extended position to said retracted position along with said workpiece contact element and when said first uppermost one of said collated strip of fasteners is disposed within said tool drive bore in preparation for being driven out of said fastener driving tool by said driver mechanism, for partially closing said slot connecting said tool magazine to said tool drive bore so as to support and maintain coaxial alignment of said first uppermost one of said collated strip of fasteners within said tool drive bore while said first uppermost one of said collated strip of fasteners is driven through said tool drive bore so as to effectively prevent misalignment of said first uppermost one of said collated strip of fasteners with respect to said tool drive bore as said first uppermost one of said collated strip of fasteners is driven through said tool drive bore in order to effectively prevent jamming of said first uppermost one of said collated strip of fasteners within said tool drive bore.

14. The fastener driving tool as set forth in claim 13, wherein:

said pocket formed upon said support device comprises a pair of oppositely disposed prongs.

15. The fastener driving tool as set forth in claim 13, wherein:

said pocket formed upon said support device comprises a tubular finger.

16. A fastener driving tool, comprising:

a workpiece contact element mounted upon said tool for movement between an extended position and a retracted position;

a drive bore defined within said tool through which a fastener is to be driven so as to be discharged from said tool;

a driver mechanism movably disposed within said drive bore for driving a fastener through said drive bore;

a tool magazine for holding a plurality of fastener;

a collated strip of fasteners disposed within said tool magazine such that a first uppermost one of said collated strip of fasteners is disposed within said drive bore of said tool in readiness to be driven out of said tool by said driver mechanism; and a support device attached to said workpiece contact element, so as to be movable with said workpiece contact element between said extended and retracted positions, and comprising a pocket for enveloping a tip portion of a second uppermost one of said collated strip of fasteners disposed within said tool magazine, when said support device is moved from said extended position to said retracted position along with said workpiece contact element and when said first uppermost one of said collated strip of fasteners is disposed within said drive bore of said tool in preparation for being driven out of said tool by said driver mechanism, wherein said pocket means comprises an upstream shear edge portion for causing shearing of a collation strip member of said collated strip of fasteners at a substantially consistent position which is located halfway along the interface connecting said first uppermost one of collated strip of fasteners to said second uppermost one of said collated strip of fasteners.

17. The fastener driving tool as set forth in claim 16, wherein:

said pocket formed upon said support device comprises a pair of oppositely disposed prongs.

18. The fastener driving tool as set forth in claim 16, wherein:

said pocket formed upon said support device comprises a tubular finger.

* * * * *